US010710134B2

(12) United States Patent
Seidel et al.

(10) Patent No.: US 10,710,134 B2
(45) Date of Patent: Jul. 14, 2020

(54) DEVICE FOR INCREASING THE TEMPERATURE OF ELONGATE METALLIC ROLLED STOCK AND FINISHING TRAIN FOR PRODUCING AND/OR WORKING ELONGATE METALLIC ROLLED STOCK

(71) Applicant: SMS Group GmbH, Duesseldorf (DE)

(72) Inventors: Juergen Seidel, Kreuztal (DE); Volker Kunze, Siegen (DE); Markus Langejuergen, Wipperfuerth (DE)

(73) Assignee: SMS GROUP GMBH, Duesseldorf (DE)

( * ) Notice: Subject to any disclaimer, the term of this patent is extended or adjusted under 35 U.S.C. 154(b) by 749 days.

(21) Appl. No.: 15/039,885

(22) PCT Filed: Sep. 12, 2014

(86) PCT No.: PCT/EP2014/694700
§ 371 (c)(1),
(2) Date: May 27, 2016

(87) PCT Pub. No.: WO2015/078604
PCT Pub. Date: Jun. 4, 2015

(65) Prior Publication Data

US 2017/0001227 A1 Jan. 5, 2017

(30) Foreign Application Priority Data

Nov. 29, 2013 (DE) ..... 10 2013 224 547

(51) Int. Cl.
*B21B 45/00* (2006.01)
*B21B 39/14* (2006.01)

(52) U.S. Cl.
CPC ..... *B21B 45/004* (2013.01); *B21B 39/14* (2013.01)

(58) Field of Classification Search
CPC ..... B21B 39/14; B21B 45/004
(Continued)

(56) References Cited

U.S. PATENT DOCUMENTS 3,877,867 A * 4/1975 Tsuchiya ..... B21B 45/004 266/103
5,634,360 A * 6/1997 Tazoe ..... B21B 39/14 72/12.5

(Continued)

FOREIGN PATENT DOCUMENTS

| | | |
|---|---|---|
| CA | 2633942 | 7/2007 |
| JP | 11123438 | 5/1999 |
| RU | 95119042 | 11/1997 |

*Primary Examiner* — Jessee R Roe
*Assistant Examiner* — Michael Aboagye
(74) *Attorney, Agent, or Firm* — Abelman, Fraybe & Schwab

(57) ABSTRACT

An apparatus (1) for increasing the temperature of elongate metallic rolled stock (2), having a heating unit (3) which comprises induction heating elements (4, 5, 6, 7; 104, 105, 106, 107) for heating the rolled stock (2) along a heating zone (8), and having a conveying device (15) which comprises driving and/or roller table roller elements (27, 28) as active or passive conveying elements (18) for moving the rolled stock (2) along the longitudinal extension (9) of the heating zone (8), wherein the induction heating elements (4, 5, 6, 7; 104, 105, 106, 107) are arranged spaced apart from one another in the longitudinal extension (9) of the heating zone (8) in each case by a free space (10, 11, 12), and wherein a sliding deflector element (34, 35, 36, 37, 38, 39, 40, 41, 73) and/or opposing lateral guide elements (60, 61) are arranged in each of the free spaces (10, 11, 12) in order to prevent the conveyed rolled stock (2) from coming into contact with the induction heating elements (4, 5, 6, 7; 104, 105, 106, 107).

21 Claims, 4 Drawing Sheets

(58) Field of Classification Search
USPC ..... 266/249, 252, 258, 103, 104, 277; 72/11.3, 12.2, 161, 202, 210, 250, 365.2, 72/342.96
See application file for complete search history.

(56) References Cited

U.S. PATENT DOCUMENTS

| | | | | |
|---|---|---|---|---|
| 5,927,118 | A * | 7/1999 | Minote | B21B 37/28 72/11.3 |
| 6,449,996 | B1 * | 9/2002 | Hirabayashi | B21B 1/26 72/11.5 |
| 2008/0236235 | A1 | 10/2008 | Hino | |
| 2010/0175452 | A1 | 7/2010 | Ohlert | |

* cited by examiner

DEVICE FOR INCREASING THE TEMPERATURE OF ELONGATE METALLIC ROLLED STOCK AND FINISHING TRAIN FOR PRODUCING AND/OR WORKING ELONGATE METALLIC ROLLED STOCK

RELATED APPLICATIONS

This application is a National Stage Application of International Application PCT/EP2014/069470 filed Sep. 12, 2014 which designates the U.S.A. and claims priority of German application DE 10 2013 224 547.5 filed Nov. 29, 2013, both the International Application PCT/EP2014/069470 and German Application DE 10 2013 224 547.5 are incorporated herein by reference thereto.

BACKGROUND OF THE INVENTION

1. Field of the Invention

The invention relates to a device (an apparatus) for increasing the temperature of elongate metallic rolled stock, having a heating unit which comprises induction heating elements for heating the rolled stock along a heating zone and having a conveying device which comprises driving and/or roller table roller elements as active or passive conveying elements for moving the rolled stock along the longitudinal extension of the heating zone, the induction heating elements being arranged spaced apart from one other in the longitudinal extension of the heating zone in each case by a free space.

The invention further relates to a finishing train for producing and/or working elongate metallic rolled stock, having an apparatus for increasing the temperature of the elongate metallic rolled stock.

2. Description of Related Art

Generic apparatuses for heating elongate metallic rolled stock, such as strips, slabs or the like, in a desired manner are well known in the prior art. In these apparatuses, the elongate metallic rolled stock must frequently be guided past a series of induction heating elements that have an induction heating element clearance height which is designed to be relatively narrow so that the rolled stock can be guided as close as possible past the induction heating elements, thereby allowing maximum efficiency with respect to the heating unit to be achieved. This is particularly the case when thinner strips 8 mm to 30 mm in thickness, for example, are to be heated by means of a longitudinal field induction heating element. It is known that upstream of a corresponding induction heating element zone, or heating zone—as viewed in the direction of conveyance—any irregularities, bulges and/or strip skis with respect to the elongate metallic rolled stock can be reduced, for example, using a strip straightener or a leveler and/or by means of a crop cut at the strip head. Depending on the prevailing constraints of the respective apparatus, however, bulges, strip skis or the like may still be present. Furthermore, bulging of the elongate metallic rolled stock may change or even increase over a longer induction heating element zone, for example 3 m in length, for example due to uneven heating or asymmetrical temperature losses from the top to the bottom side of the elongate metallic rolled stock. Moreover, in the case of a failure of units downstream, disruptions in material flow, a power failure during conveyance of the rolled stock, etc., a strip loop may form in the region of the induction heating element zone.

These effects, described merely by way of example, can cause the elongate metallic rolled stock to come into contact with one or more of the induction heating elements, resulting in permanent damage to the heating unit.

To reduce the risk of contact between the elongate metallic rolled stock and the induction heating elements within an induction heating element zone, document CA 2 633 942 C discloses an apparatus comprising a strip edge heater with induction heating elements, which are arranged on either side of a central longitudinal axis of a heating zone of the apparatus. Both upstream and downstream of the induction heating elements, components of a leveler are positioned for leveling the rolled stock. These components are additionally connected to one another via an elongate center component of the leveler, so that the leveler extends in its entirety continuously along the induction heating element zone from an intake region upstream of the induction heating element zone up to an output region downstream of the induction heating element zone. With this leveler configuration, the rolled stock can continue to be leveled during the heating of its edge regions. However, the continuous configuration of the leveler makes the apparatus quite large. In addition, particularly with thinner rolled stock, such as thinner strips or the like, the leveler thus configured cannot positively prevent lateral regions of the thinner rolled stock from coming into contact with the induction heating elements when corresponding deformation occurs despite the center component. In this respect, the apparatus described in the cited document is in no way suitable for increasing the temperature of thinner rolled stock by means of longitudinal field induction. Furthermore, this leveler has an adverse effect on the heating of the rolled stock because the elongate center component is arranged at the center of the heating zone. This center component is therefore also disadvantageously exposed to tremendous heat. Moreover, due to the positioning of the elongate center component of the leveler, this configuration is suitable only for use in conjunction with a strip edge heating system. And the leveler known from document CA 2 633 942 C cannot even be used with induction heating elements that are arranged continuously from one side to the other side.

Further, from Japanese abstract JP 11 123 438 A another hot rolling mill is known, which has an induction heating unit having a plurality of induction heating coils for heating elongate metallic rolled stock. In this case, the elongate metallic rolled stock is conveyed in the direction of transport through the respective induction heating coil gap. To eliminate the risk of the elongate metallic rolled stock inadvertently colliding with the inner sides of the induction heating coils, two or more tubular elements are disposed between each of the induction heating coils and both the upper side and the underside of the elongate metallic rolled stock. The tubular elements disposed on the upper side and the underside of the elongate metallic rolled stock in each induction heating coil extend with their longitudinal extension in the direction of transport of the elongate metallic rolled stock, and are arranged side by side and spaced from one another transversely to the direction of transport. The tubular elements in this case are bent in a U-shape with the ends thereof facing away from the respective induction heating coil. Coolant connections are provided at the ends, since a coolant flows through the tubular elements to cool them. This is essential because the tubular elements are positioned in the region of the induction field between the inner sides of the induction heating coils and the elongate metallic rolled stock. They are thus exposed directly to a corresponding heat load. A further disadvantage is that this configuration also adversely affects the heating output of the induction device. In addition, the tubular elements further constrict the inductor passage dimensions.

The object of the invention is to further develop apparatuses for heating elongate metallic rolled stock, in particular thinner metallic strips such as thin steel strips, such that the risk of contact with and possible damage particularly to induction heating elements by elongate metallic rolled stock can be extensively avoided.

SUMMARY OF THE INVENTION

The object of the invention is attained by an apparatus for increasing the temperature of elongate metallic rolled stock, having a heating unit which comprises induction heating elements for heating the rolled stock along a heating zone, and having a conveying device which comprises driving and/or roller table roller elements as active or passive conveying elements for moving the rolled stock along the longitudinal extension of the heating zone, wherein the induction heating elements are arranged spaced apart from one other in the longitudinal extension of the heating zone in each case by a free space, and wherein a sliding deflector element and/or mutually opposing lateral guide elements (60, 61) are arranged in particular completely within each free space, to prevent the conveyed rolled stock from coming into contact with the induction heating elements.

As a result, in particular, of a sliding deflector element so placed between two induction heating elements which are arranged successively along the longitudinal extension of the heating zone, the actual heating zone is free of interfering components, thereby ensuring, in particular, heating over the surface area of the elongate metallic rolled stock, and effective heating due to a minimal passage dimension in the heating zone. Nevertheless, the risk of the elongate metallic rolled stock unintentionally colliding with one of the induction heating elements, for example, in a hot strip mill as the rolled stock is being conveyed through the heating zone is specifically prevented. Primarily, the strip transport of thinner strips or the like through the heating zone is expediently made safer.

This is achieved even if the apparatus comprises lateral guide elements arranged opposite one another in the free space and between two immediately adjacent induction heating elements. Lateral guide elements arranged in this manner reliably ensure the lateral guidance of the conveyed rolled stock transversely to the heating zone. The guidance function is then interrupted only by the induction heating elements.

Because the sliding deflector element and/or the lateral guide elements are preferably arranged completely within the space between every two induction heating elements, the sliding deflector element and/or the lateral guide elements advantageously have no negative impact on the heating output of the induction heating elements acting on the rolled stock, since the sliding deflector element and/or the lateral guide elements are disposed adjacent to the induction heating elements rather than between them and the rolled stock. Thus both the sliding deflector element and the lateral guide elements are arranged outside of a corresponding heating area of each induction heating element.

The term "completely" as used in the invention refers to the fact that deflector slide surfaces or other related regions of the sliding deflector element that interact particularly with the rolled stock are disposed within the region of the free spaces between the induction heating elements.

It is thus advantageous for the sliding deflector element and/or the mutually opposing lateral guide elements to be disposed outside of one of the surfaces of the induction heating elements that faces the rolled stock.

In this respect, the apparatus according to the invention can be operated much more reliably than has heretofore been possible in the prior art. In general, this apparatus enables a rolling mill to be operated more safely, thereby also enabling the output capacity of a corresponding finishing train for the production of elongate metallic rolled stock to be increased.

In the present case, the free spaces and the induction heating elements are arranged alternating with one another along the longitudinal extension of the heating zone, and thus alternatingly.

The object is also attained by a finishing train for producing and/or working elongate metallic rolled stock, having an apparatus for increasing the temperature of the elongate metallic rolled stock, wherein the finishing train comprises an apparatus for increasing the temperature of elongate metallic rolled stock according to one of the features described herein.

Particularly if the finishing train comprises a continuous casting rolling mill, a malfunction due to a problem in the region of a heating zone of the apparatus for increasing the temperature can bring the entire production operation to a standstill, for example resulting in a discontinuation of casting during the continuous rolling of strips. It is thus advantageous for the present apparatus to be used in conjunction with such a continuous casting rolling mill.

The term "elongate metallic rolled stock" as used in the present invention describes metal or steel strips produced by hot rolling, or metal or metallic sheets, slabs, cast strips or the like that will be subjected to a temperature increase for further processing.

For such a temperature increase, the apparatus comprises a heating unit having a plurality of induction heating elements, preferably longitudinal field induction heating elements. Thus the term "heating unit" specifically also preferably refers to a longitudinal field induction heating element, which in the context of the invention is used in the apparatus according to the invention. The apparatus of the invention is thus particularly well suited for increasing the temperature of elongate metallic rolled stock having a rolled stock thickness greater than 6 mm.

The term "sliding deflector element" in the context of the invention describes any elements by which it is possible to keep the conveyed rolled stock spaced apart from the induction heating elements, without execution of any substantial movement, such as rotational movement, by a motorized drive and without movement of the rolled stock.

Thus the sliding deflector element is characterized in particular in that it is configured as preferably completely fixed and in particular rotationally fixed in relation to the conveyed rolled stock, especially when the conveyed rolled stock comes into active contact with the sliding deflector element as the rolled stock is being moved or conveyed through the heating zone in the direction of conveyance. In this respect, the deflector element has a braking effect on the movement of the rolled stock.

The active or passive conveying elements of the conveyor differ from this sliding deflector element in that these conveying elements facilitate and even initiate the movement of the rolled stock through the heating zone. The active conveying elements thus comprise, for example, motorized driving roller elements, by means of which the rolled stock can be accelerated. The passive conveying elements, on the other hand, comprise roller table roller elements, for example, on which the rolled stock can roll.

A preferred alternative variant provides that the sliding deflector element is disposed between one of the active or passive conveying elements and one of the induction heating elements. In this case, the sliding deflector element is preferably positioned at the level of the driving and/or roller table roller elements and the induction heating elements such that the elongate metallic rolled stock can not only be particularly effectively kept spaced at a distance from the individual induction heating elements, but can also advantageously be guided toward the active or passive conveying elements, if any are provided.

It is understood that the sliding deflector element has many possible configurations. It is particularly advantageous, however, for the sliding deflector element to comprise a deflector top section, which is fixed in relation to the conveyed rolled stock. The sliding deflector element may project only partially into the heating zone with this deflector top section.

The sliding deflector element or the related deflector top section may be configured, for example, as a deformation-resistant panel element or may consist of a plurality of panel elements.

Alternatively, the sliding deflector element or the related deflector top section may be designed in the form of at least one narrow rib element. If a plurality of rib elements are provided, heat insulating panels or mats may be arranged between the individual rib elements, advantageously allowing two functions to be fulfilled, specifically that of a sliding deflector element and that of a heat insulating unit.

The sliding deflector element may also be made of a temperature-resistant material.

The interior of at least this deflector top section is preferably liquid cooled, to better protect it against critical heating by the heat radiated, for example, from a heated slab or hot sheet or the like.

Coolant is preferably supplied in particular to an adjustable deflector top section via a flexible hose connection.

It is further extremely advantageous for the sliding deflector element to comprise a sloped side having an inclined run-in surface, so that the rolled stock can be better diverted into the designated conveyance plane.

The respective induction heating element can be protected particularly well over its surface area against collision with the rolled stock when the sliding deflector element is arranged with its long side perpendicular to the longitudinal extension of the heating zone in the free space.

The sliding deflector element is particularly expediently positioned extending over more than 60%, preferably more than 90%, of the width of the heating zone. In this case, the sliding deflector element thus extends transversely to the heating zone or transversely to the longitudinal extension of the heating zone.

If the sliding deflector element is positioned in free spaces situated above and/or below a conveyance plane of the heating zone between two immediately adjacent induction heating elements, the rolled stock can be advantageously guided through the heating zone in relation to upper induction heating element regions and in relation to lower induction heating element regions.

It is further advantageous for at least two sliding deflector elements to be arranged opposite one another vertically—in relation to the heating zone—as a deflector unit. Such an arrangement allows the upper and lower induction heating elements to be particularly well protected against mechanical damage. Frequently, a roller table roller element on the underside and a sliding deflector element on the top side are arranged facing one another between two induction heating elements.

It is further advantageous for a plurality of deflector units consisting of vertically opposing sliding deflector elements to make up a height restricting device that extends along the longitudinal extension of the heating zone. This height restricting device can restrict the passage height of the heating zone particularly effectively, so that both the upper and lower induction heating element regions are very well protected against mechanical damage.

It is also advantageous for at least two sliding deflector elements to be arranged opposite roller table roller elements—in relation to the heating zone—as a deflector unit.

A further preferred arrangement provides for the sliding deflector elements and the induction heating elements to be arranged alternating with one another along the heating zone. With this alternating arrangement, it can be ensured that—as viewed in the conveying direction or in the longitudinal extension of the heating zone—a sliding deflector element is positioned both upstream and downstream of each induction heating element, thereby further improving the protection of the individual induction heating elements.

It is understood that the position of the sliding deflector element opposite the nearest induction heating element may be differently selected. It has been found, however, that the position of the sliding deflector element is particularly advantageous when the apparatus is characterized by a horizontal distance $A_{Hori}$ between the sliding deflector element and an immediately adjacent induction heating element, by an induction heating element distance $A_{INDHori}$ and by a sliding deflector element width B, where $A_{Hori}=\frac{1}{2}\times(A_{INDHori}-B)=(0 \text{ to } 25\%)\times A_{INDHori}$.

It has proven to be particularly advantageous for the lower conveying element in particular to be spaced less than 100 mm, preferably less than 40 mm, from the nearest induction heating element or the nearest induction heating elements, as viewed in the direction of transport.

Furthermore, a collision of the rolled stock with one of the induction heating elements can be even more effectively prevented if the apparatus is characterized by an induction heating element passage height $H_{IND}$ and by a vertical distance $A_{VertA}$ or $A_{vertF}$ between an upper sliding deflector element and a lower sliding deflector element or a lower conveying element, with $A_{vertA}$ or $A_{VertF} \leq H_{IND}$.

It has further been found to be effective, with an induction heating element passage height $H_{IND}<200$ mm, preferably <80 mm, for at least one sliding deflector element to be disposed in one of the free spaces. This enables any irregularities that may be produced or may be present on the rolled stock to be better deflected.

It is further advantageous for the apparatus to be characterized by a difference $\Delta x$ between an induction heating element passage height $H_{IND}$ and a rolled stock thickness h, with $\Delta x=H_{IND}-h\leq 125$ mm.

A ratio V of a rolled stock thickness h to an induction heating element passage height $H_{IND}$ of $V=(h/H_{IND})\leq 0.5$ or preferably $V=(h/H_{IND})\leq 0.25$ is likewise advantageous.

In particular, the structural design of the present apparatus can be further simplified if the sliding deflector element comprises a driving and/or roller table roller element.

It is further advantageous for the sliding deflector element to be vertically adjustable in relation to a conveyance plane of the heating zone and/or displaceable in relation to the induction heating elements.

The apparatus may be further advantageously characterized by a horizontal distance $A_{HoriS}$ between the lateral guide element and an immediately adjacent induction heating element, an induction heating element passage width $B_{IND}$ and a lateral guide passage width $B_F$, where $A_{HoriS}=\frac{1}{2}\times(B_{IND}-B_F)=(0 \text{ to } 25\%)\times B_{IND}$.

Furthermore, it is highly advantageous for a plurality of lateral guide units consisting of horizontally opposing lateral guide elements to make up a width restricting device along the longitudinal extension of the heating zone. This width restricting device can restrict the passage width of the heating zone particularly effectively, so that the rolled stock is also effectively guided laterally within the conveyance plane.

The guidance width is ideally set somewhat narrower than an inner width dimension of an induction heating element, preferably less than or equal to 100 mm.

It is further advantageous for the lateral guide elements to be firmly fixed in a maximum position. Alternatively, the inner width dimension may be adjustable, preferably in groups, based on the rolled stock width.

Furthermore, the lateral guide elements may also be uncooled and made of a temperature resistant material. Alternatively, they may be internally cooled.

It is understood that the present sliding deflector elements or deflector units and the lateral guide elements or lateral guide units can be structurally embodied in many ways, jointly or individually.

An extremely reliable guidance through the heating zone and past the induction heating elements can be ensured when a deflector unit comprising at least two vertically opposing sliding deflector elements and/or a lateral guide unit comprising two horizontally opposing lateral guide elements jointly or each at least partially make up a rolled stock infeed device. The same also applies to a guide comprising at least one sliding deflector element and one vertically opposing roller table roller element.

In this case, the deflector unit and a lateral guide unit corresponding to this deflector unit may form one complete unit, or each may be configured separately.

At this point it should be noted that different types of induction heating elements may be used in conjunction with the heating unit employed in the present apparatus, particularly induction heating elements of a closed or open design.

With induction heating elements of a closed design, the elongate metallic rolled stock must generally be transported through an opening in a rectangular ring-shaped, rigid frame of the induction heating element. In order for the rolled stock to enter into the opening of this frame without difficulty, the strip head of the rolled stock is cropped with shears in advance and/or the rolled stock is guided through a stand-alone strip leveler, comprising, for example, three to five leveling rolls. Upstream of and within the heating zone, the sliding deflector elements are arranged at the top and optionally at the bottom, and/or additional lateral guide elements are arranged on both sides of the heating zone, preferably between every two induction heating elements, in order to make the transport through the heating zone operationally reliable. This measure forms a virtual tunnel, which effectively prevents the rolled stock from touching the induction heating elements or other structural components and from becoming snagged on the induction heating elements, at the top, on the bottom, and optionally on the sides. Deflector slide elements and lateral guide elements therefore alternate with induction heating elements in their arrangement along the longitudinal extension of the heating zone. Additionally or alternatively to the sliding deflector elements, conveying elements could also be disposed upstream of and/or between the individual induction heating elements to thereby improve the advancement of the rolled stock through the heating zone and/or to enable a deflection, holding down or centering of the rolled stock, particularly in the region of the free spaces.

Alternatively, split and preferably adjustable induction heating elements of an open design may be used, which comprise two halves, in particular a lower part and an upper part, which can extend around the rolled stock in a C-shape. In this case, the corresponding electromagnetic longitudinal field is generated by the spatially separated halves of the induction heating element. The current is thus fed back in each case on one side of the rolled stock within a closed housing. Split induction heating elements have the advantage over closed induction heating elements that the induction heating element passage height is adjustable. That is, the upper and lower halves of an induction heating element, or the upper and lower parts of an induction heating element are physically movable relative to one another. In this embodiment, for example, a leveler or strip leveler or a cropping shear upstream of the heating zone can be easily dispensed with, or transport safety can be additionally enhanced by using all of these measures. This is true particularly in the case of a heating unit having induction heating elements in a continuous casting rolling mill in which the strip head length is very short as compared with the length of the entire continuous strip. In this case, it is important primarily for the strip head to be guided reliably through the heating zone, which can be advantageously achieved by opening the induction heating elements wider in the region of the current strip head position, in order to allow a ski, a strip bulge or the like to pass through. The individual induction heating elements are then closed again, adjusted to the operating position and then activated, particularly when a corresponding strip tension has built up in the region of the heating zone. With this longitudinal field inductor principle, the induction heating element passage height can be set as very narrow, thereby allowing the efficiency of the induction heating elements and thus the entire heating output acting on the rolled stock to be advantageously increased. Added to this is the certainty that, in the event of malfunctions or rolled stock displacements of any kind, the corresponding induction heating element can be backed out, thereby better protecting it from further mechanical damage resulting from contact with the rolled stock. Upstream of and particularly within the heating zone, the sliding deflector elements are additionally arranged at the top and optionally at the bottom, and the lateral guide elements are also optionally arranged on both sides, preferably between each of the provided induction heating elements, so as to make transport through the heating zone particularly reliable, and to prevent the top, the bottom or the sides of the rolled stock from becoming snagged on or from touching one of the induction heating elements. It is particularly advantageous for the induction heating elements to be capable of opening wide in the event of a malfunction. This can be accomplished, for example, by lifting the upper induction heating element halves off completely or swiveling them upward. Additionally or alternatively, the induction heating elements can be moved out laterally crosswise to the longitudinal extension of the heating zone.

It is understood that the sliding deflector elements, but also the additional lateral guide elements can be integrated or supported in the present apparatus in almost any way. For example, the sliding deflector elements and the induction heating elements may be secured to a common supporting frame. This allows them to be ideally adjusted jointly vertically, displaced laterally crosswise to the longitudinal extension of the heating zone, or swiveled away. Alternatively, the position of the sliding deflector elements, the lateral guide elements and the induction heating elements may be adjusted separately. Moreover, it is also conceivable for the sliding deflector elements to occupy a fixed position, and thus to be arranged stationary in the apparatus, in which case only the induction heating elements are correspondingly adjustable.

In this respect the sliding deflector elements can particularly be fixed or can be incrementally or continuously height adjustable.

It is thus advantageous for the sliding deflector elements to be vertically adjustable.

It is expedient for the sliding deflector elements to be vertically adjustable, alone or jointly in a frame with adjustable induction heating elements.

The sliding deflector elements, but also the lateral guide elements can be advantageously made of ferritic or preferably austenitic material, such as a stainless steel, a nickel-based alloy or a chromium-nickel-iron alloy, but also of refractory concrete, ceramics or the like.

It is therefore advantageous for the sliding deflector elements to be made of a temperature-resistant material and/or to be internally cooled, with a coolant supply to a cooled sliding deflector element having a hose connection.

A hose connection enables a structurally simple implementation of a flexible connection to vertically adjustable deflector elements.

It is further advantageous for the sliding deflector elements and the lateral guide elements to be electrically insulated in relation to the other metallic components. Alternatively, other measures may be implemented for interrupting an induced circuit.

Preferably, not only can the interior of the sliding deflector elements and optionally of the lateral guide elements be liquid cooled, but also the interior of the additional conveying elements, such as driving roller elements, roller table roller elements, and hold-down roller elements.

It is further advantageous for the apparatus to directly comprise a leveling device for leveling the rolled stock. However, such a leveler may also be advantageously dispensed with if the heating unit comprises split induction heating elements.

Advantageously, with the present apparatus, undesirable contact between the elongate metallic rolled stock and the induction heating elements can be consistently and reliably prevented, regardless of the design of the induction heating elements.

Furthermore, the risk of general damage to the elongate metallic rolled stock, such as jamming of the elongate metallic rolled stock at the strip head within the heating zone, is particularly effectively reduced.

Further advantages, objects and characteristics of the present invention will be detailed in reference to the attached set of drawings and the following description, which depict and describe an example of an apparatus for increasing the temperature, having induction heating elements and having sliding deflector elements, which are stationary in relation to the conveyed rolled stock and which are arranged in free spaces formed by induction heating elements arranged one in front of the other along a heating zone.

Components which correspond at least substantially with regard to their function in the individual figures can be identified by the same reference signs, and the components need not be marked and described in each of the figures.

DETAILED DESCRIPTION OF THE PREFERRED EMBODIMENT

Figure 1:
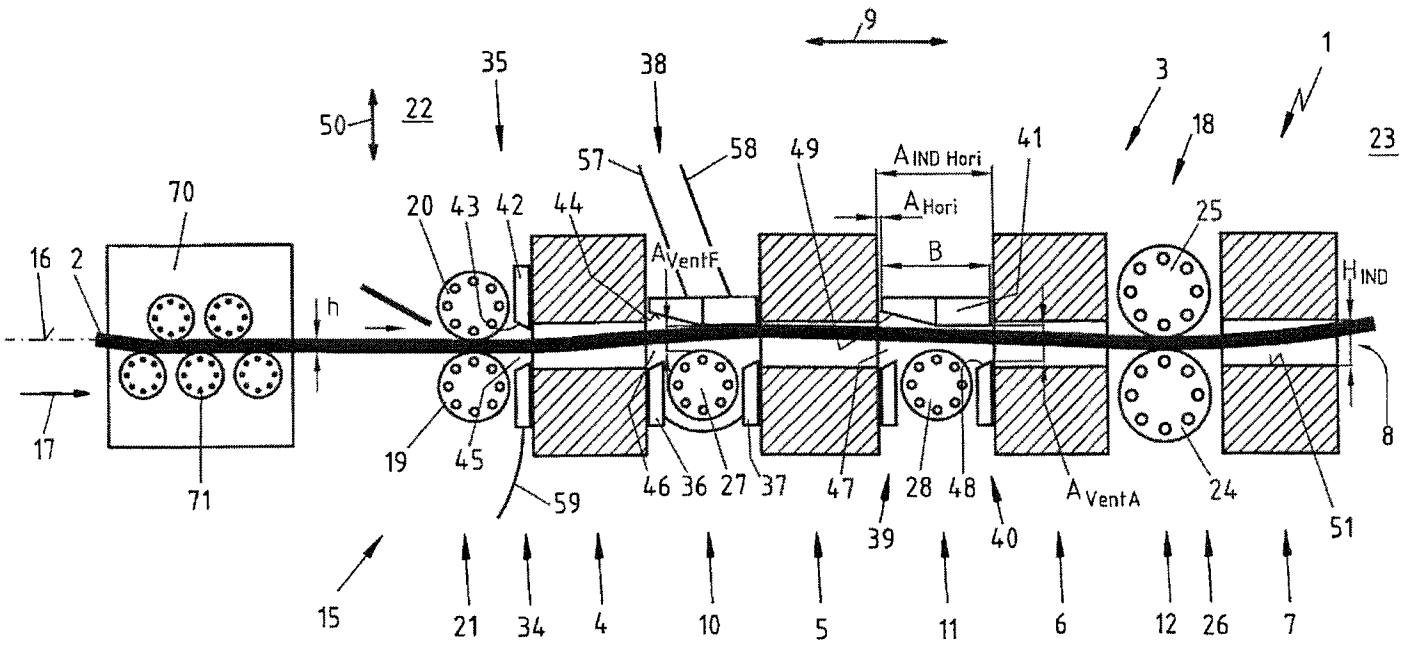
FIG. 1 a schematic side view of a temperature increasing apparatus having integral induction heating elements arranged successively along a heating zone and closed in the form of a ring, and having sliding deflector elements arranged therebetween.
Figure 2:
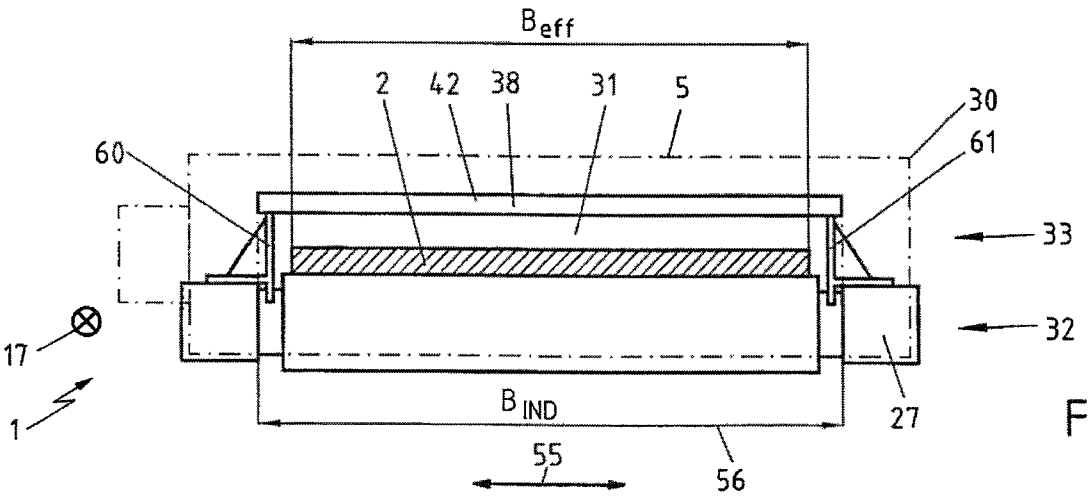
FIG. 2 a schematic cross-sectional view of the apparatus of FIG. 1 with additionally mounted lateral guide elements.

The apparatus 1, shown in FIGS. 1 and 2, for increasing the temperature of elongate metallic rolled stock 2 has a heating unit 3 which comprises a total of four induction heating elements 4, 5, 6 and 7. The four induction heating elements 4 to 7 are arranged successively along a heating zone 8 of heating unit 3, in other words along the longitudinal extension 9 of heating zone 8, so that together the four induction heating elements 4, 5, 6 and 7 form a longitudinal field induction heating unit (not labeled separately here). The four induction heating elements 4, 5, 6 and 7 are arranged relative to one another in apparatus 1 such that they are spaced apart from one another along heating zone 8 by a horizontal distance $A_{INDHori}$, producing a corresponding forward free space 10 between the two induction heating elements 4 and 5, a corresponding center free space 11 between the two induction heating elements 5 and 6, and finally a corresponding rear free space 12 between the two induction heating elements 6 and 7.

Apparatus 1 further comprises a conveying device 15, by means of which the elongate metallic rolled stock 2 is moved in a horizontally oriented conveyance plane 16 through heating zone 8 in direction of conveyance 17, and therefore past induction heating elements 4 to 7. In this embodiment example, conveying device 15 is equipped with both active and passive conveying elements 18 (numbered only by way of example).

As active conveying elements 18 in the present case, driving roller elements 19 and 20 of a forward drive unit 21 are provided in intake region 22 of heating zone 8, and in output region 23 of heating zone 8, a lower drive roller element 24 and a hold-down roller element 25 of a rear drive unit 26 are provided.

As passive conveying elements 18, two roller table roller elements 27 and 28 are provided below conveyance plane 16.

The four induction heating elements 4 to 7 in this embodiment example are each embodied as having a closed design, that is, with a rectangular ring-shaped housing part 30 (see in particular FIG. 2) with a fixed rolled stock passage opening 31. This means that an upper part 32 and a lower part 33 of each induction heating element 4, 5, 6 and 7 are fixedly disposed relative to one another and are thus rigidly connected to one another.

In order for the potentially bulging rolled stock 2 that is moved in direction of conveyance 17 through heating zone 8 to be conveyed reliably without contact through the fixed rolled stock passage openings 31 of four induction heating elements 4, 5, 6 and 7 without coming into mechanical contact with even the upper and lower parts 32 and 33 of the four induction heating elements 4, 5, 6 and 7, apparatus 1 has a plurality of sliding deflector elements 34, 35, 36, 37, 38, 39, 40 and 41 arranged fixedly in relation to the conveyed rolled stock 2, and disposed in free spaces 10 and 11 between induction heating elements 4, 5 and 6 and cumulatively or alternatively between the active or passive conveying elements 18 and said induction heating elements 4, 5 and 6.

The upper and lower sliding deflector elements 34 and 35, and 36 or 37 and 38, and 39 or 40 and 41, respectively arranged opposite one another vertically, in each case make up one deflector unit (not specifically labeled).

Sliding deflector elements 34, 35, 36, 37, 38, 39, 40, 41 of the respective deflector units and induction heating elements 4, 5, 6, 7 are therefore arranged alternating with one another or alternatingly in succession along heating zone 8.

Sliding deflector elements 34, 35, 36, 37, 38, 39, 40 and 41 are each characterized by a panel-like deflector top section 42 (numbered only by way of example), located closer than induction heating elements 4 to 7 to conveyance plane 16. This alone reduces the risk that rolled stock 2 will come into contact with said induction heating elements 4 to 7.

The respective panel-like deflector top section 42 of sliding deflector elements 34, 35, 36, 37, 38, 39, 40 and 41 has a sloped side 43 (also labeled merely by way of example) having an inclined run-in surface 44, which is oriented counter to direction of conveyance 17.

Sloped side 43 and conveyance plane 16 ideally form an angle of more than 5° or more than 10°, for example. This means that inclined run-in surface 44 and conveyance plane 16 extend at an angle relative to one another rather than parallel to one another.

Thus at least two vertically opposing sliding deflector elements 34 and 35, and 36 and 38, and 39 and 41, along with their deflector top sections 42, always form a funnel-shaped intake region 45 (forward deflector unit), 46 (center deflector unit) and 47 (rear deflector unit), so that the conveyed rolled stock 2 can be advantageously deflected by the sliding deflector elements 34, 35, 36, 37, 38, 39, 40 and 41, which are equipped with sloped slides 43, as it is being moved along heating zone 8 in direction of conveyance 17.

Rolled stock 2 being moved in direction of conveyance 17 is prevented from becoming jammed or snagged on an edge 48 of the sliding deflector elements 34, 35, 36, 37, 38, 39, 40 and 41 that faces conveyance plane 16 by the fact that at least a leading edge region 49 of sloped side 43 is set back in vertical direction 50 behind induction heating elements 4, 5, 6 or 7 or is at least at the same level as an inner side 51, facing conveyance plane 16, of one of induction heating elements 4, 5, 6 and 7.

In other words, this means that this edge 48, facing conveyance plane 16, of each of sliding deflector elements 34 to 41, is located at a greater distance from conveyance plane 16 than the respective inner side 51 of induction heating elements 4, 5, 6 and 7.

This reduces the risk of rolled stock 2 becoming further curved or bent thus forming a loop or the like within heating zone 8 as a result of mechanical contact with one of sliding deflector elements 34, 35, 36, 37, 38, 39, 40 or 41.

As is particularly clear from the illustration of FIG. 2, each of sliding deflector elements 34, 35, 36, 37, 38, 39, 40 and 41 extend with their long side 55 oriented transversely to longitudinal extension 9 of heating zone 8.

In this case, each sliding deflector element 34, 35, 36, 37, 38, 39, 40 or 41 extends over nearly the entire heating zone width 56 of apparatus 1, so that transversely to longitudinal extension 9 of heating zone 8, a highly effective and operatively reliable two-dimensional guidance of rolled stock 2 is ensured.

In this embodiment, sliding deflector elements 34, 35, 36, 37, 38, 39, 40, 41 or at least the respective deflector top sections 42 thereof are designed as liquid cooled. This is illustrated by coolant lines 57, 58 and 59, shown and labeled by way of example.

Apparatus 1 is further characterized by a horizontal distance $A_{Hori}$ (indicated by way of example) between sliding deflector elements 34, 35, 36, 37, 38, 39, 40 or 41 and one of the immediately adjacent induction heating elements 4, 5, 6, 7, by an induction heating element distance $A_{INDHori}$ and by a sliding deflector element width B, in the following relationship:

$A_{Hori}=\frac{1}{2}\times(A_{INDHori}-B)=(0 \text{ to } 25\%)\times A_{INDHori}$. In this embodiment, $A_{Hori}$ measures less than 40 mm.

Apparatus 1 is further characterized by an induction heating element passage height $H_{IND}$ and by a vertical distance $A_{VertA}$ between an upper sliding deflector element 35 or 38 or 41 and a lower sliding deflector element 34, or 36 or 37, or 39 or 40, or by a further vertical distance $A_{vertF}$ between an upper sliding deflector element 38 or 41 and one of the lower conveying elements 27 and 28, with $A_{VertA}$ or $A_{vertF} \leq H_{IND}$. In this embodiment, $H_{IND}$ measures less than 80 mm.

Not only can a collision-free vertical guidance of rolled stock 2 with respect to induction heating elements 4 to 7 be ensured, but also a lateral horizontal guidance, since in addition to the above-described sliding deflector elements 34, 35, 36, 37 38, 39, 40, 41 arranged above and below conveyance plane 16, apparatus 1 also has lateral guide elements 60 and 61 (labeled here by way of example), arranged within the free spaces 10, 11 or 12 between two immediately adjacent induction heating elements 4 and 5 or 5 and 6, as is particularly clear from the illustration of FIG. 5.

Two lateral guide elements 60 and 61 directly opposite one another together form a lateral guide unit, and a plurality of lateral guide units that comprise horizontally opposing lateral guide elements 60 and 61 form a width restricting device along longitudinal extension 9 of heating zone 8.

The two lateral guide elements 60, 61 are aligned with their respective longitudinal side 63 (see FIG. 5) along longitudinal extension 9 of heating zone 8, with the lateral guide elements 60 and 61 being arranged with their longitudinal side 63 completely within the respective free space 10, 11 or 12 between the induction heating elements 4, 5, 6 and 7. Lateral guide elements 60 and 61 also have a lateral slope 64 with an inclined run-in surface 65, the leading region 66 of which is set back in horizontal direction 67 from induction heating elements 4, 5, 6 and 7 or is at least at the same level as a side 68 of one of induction heating elements 4, 5, 6 and 7 that faces heating zone 8.

This results in a total of three rolled stock intake funnels (not explicitly numbered), each of which is formed by a deflector unit comprising at least two vertically opposing sliding deflector elements 34 and 35 (forward rolled stock intake funnel), or 36 and 38 (center rolled stock intake funnel), or 39 and 41 (rear rolled stock intake funnel), combined with a lateral guide unit comprising two horizontally opposing lateral guide elements 60, 61.

In any case, apparatus 1 is characterized by a horizontal distance $A_{HoriS}$ between lateral guide element 60 or 61 and an immediately adjacent induction heating element 4, 5, 6 or 7, by an induction heating element passage width $B_{IND}$ and by a lateral guide element passage width $B_F$, in the following relationship to one another: $A_{HoriS}=\frac{1}{2}\times(B_{IND}-B_F)=(0 \text{ to } 25\%)\times B_{IND}$.

Figure 5:
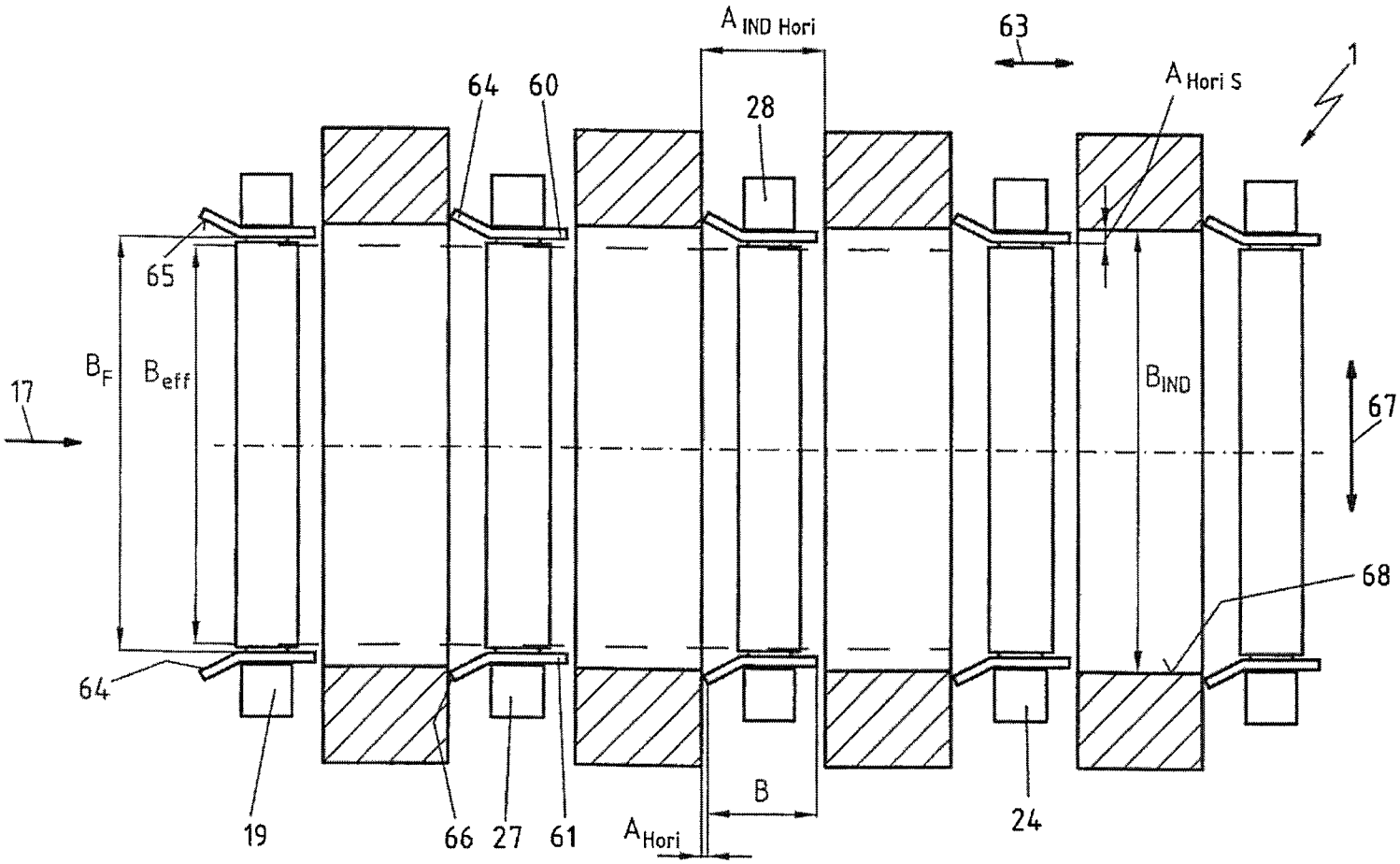
FIG. 5 a schematic plan view of an example of a possible heating zone in conjunction with the temperature increase apparatus of FIGS. 1 to 4, having induction heating elements arranged successively, and having sliding deflector elements and lateral guide elements arranged therebetween.

The two lateral guide elements 60 and 61 each define an effective usable heating zone width $B_{eff}$, which is smaller than the inside dimension $B_{IND}$ of induction heating elements 4 to 7, as shown by the illustration of FIG. 5.

Since the induction heating element passage height $H_{IND}$ is fixedly defined particularly in this embodiment example and cannot be adjusted, apparatus 1 is still equipped with a conventional leveler 70 comprising five leveling rolls 71 (labeled only by way of example), which is positioned upstream of the actual heating zone 8. By means of leveler 70, the elongate metallic rolled stock 2 is leveled in a known manner before it reaches forward drive unit 21.

Figure 4:
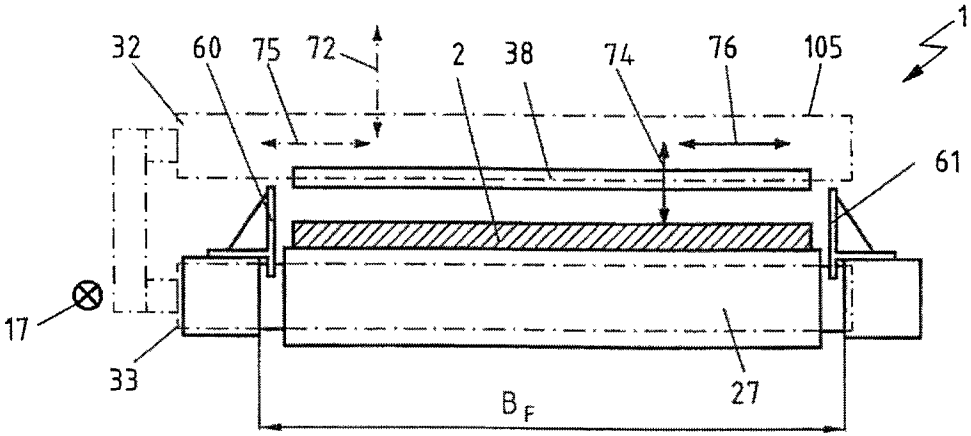
FIG. 4 a schematic cross-sectional view of the apparatus of FIG. 3.
Figure 3:
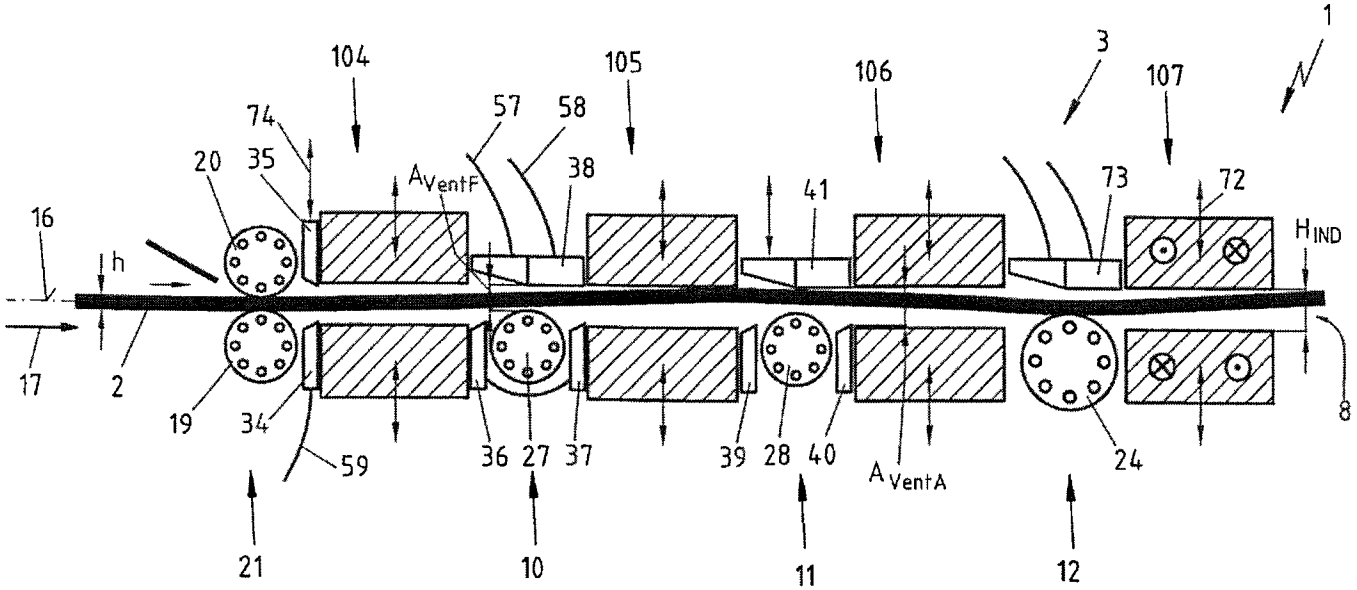
FIG. 3 a schematic side view of the temperature increasing apparatus of FIGS. 1 and 2 with induction heating elements arranged successively along a heating zone and split into two, and therefore alternative (current feedback within the respective inductor halves)

A second embodiment is shown in FIGS. 3 and 4; in the following, only those features by which this second embodiment example differs from the first embodiment example (cf. FIGS. 1 and 2) will be described.

Alternatively, in the apparatus 1 shown in FIGS. 3 and 4 a leveler 70 of this type can be readily dispensed with if heating unit 3 is equipped with other induction heating elements 104, 105, 106 and 107 of an open design. This means that each of induction heating elements 104, 105, 106 and 107 has an upper part 32 and a lower part 33, which can be displaced relative to one another such that the induction heating element passage height $H_{IND}$ can be variably adjusted.

For this purpose, induction heating elements 4 to 7 are mounted in a frame (not shown here) of apparatus 1, so that their upper and lower parts 32 and 33 can also independently execute vertical movements according to vertical arrow 72 (labeled only by way of example).

In addition, at least the upper sliding deflector elements 35, 38, 41 and 73 can also independently execute vertical movements according to additional vertical arrow 74 (labeled only by way of example), so that the height of these sliding deflector elements can be adjusted in relation to lower sliding deflector elements 34, 36, 37, 39 and 40 and in relation to roller table roller elements 27 and 28. Induction heating elements 104 to 107 can be moved independently of one another laterally in the direction of arrow 75, and upper sliding deflector elements 35, 38, 41 and 73 can be moved independently of one another laterally in the direction of arrow 76.

It should be explicitly noted that the features of the solutions described above and in the claims and/or figures, where appropriate, may be combined in order to cumulatively implement or achieve the aforementioned features, effects and advantages.

It is understood that the above-described embodiment examples are merely initial embodiments of the apparatus according to the invention. The implementation of the invention is not limited to these embodiments.

LIST OF REFERENCE SIGNS

1 apparatus
2 rolled stock
3 heating unit
4 first induction heating element
5 second induction heating element
6 third induction heating element
7 fourth induction heating element
8 heating zone
9 longitudinal extension
10 forward free space
11 center free space
12 rear free space
15 conveying device
16 conveyance plane
17 conveyance direction
18 active or passive conveying elements
19 lower driving roller element
20 upper driving roller element
21 front drive unit
22 intake region
23 output region
24 lower rear driving roller element or roller table roller element
25 hold-down roller element
26 rear drive unit
27 front roller table roller element
28 rear roller table roller element
30 rectangular ring-shaped housing part
31 fixed rolled stock passage opening
32 lower part
33 upper part
34 first sliding deflector element
35 second sliding deflector element
36 third sliding deflector element
37 fourth sliding deflector element
38 fifth sliding deflector element
39 sixth sliding deflector element
40 seventh sliding deflector element
41 eighth sliding deflector element
42 deflector top section
43 sloped side
44 inclined run-in surface
45 forward funnel-shaped intake region
46 center funnel-shaped intake region
47 rear funnel-shaped intake region
48 edge
49 initial region
50 vertical direction
51 inner side
55 long side
56 heating zone width
57 first coolant line
58 second coolant line
59 additional coolant line
60 left lateral guide element
61 right lateral guide element
63 longitudinal side
64 lateral slope
65 lateral inclined run-in surface
66 leading region
67 horizontal direction
68 side
70 leveler
71 leveling rolls
72 vertical arrow
73 ninth sliding deflector element
74 additional vertical arrow
75 arrow direction
76 arrow direction

104 alternative first induction heating element
105 alternative second induction heating element
106 alternative third induction heating element
107 alternative fourth induction heating element
$A_{Hori}$ horizontal distance
$A_{INDHori}$ induction heating element distance
B deflector element width
$A_{VertA}$ vertical distance upper deflector element/lower deflector element
$A_{vertF}$ additional vertical distance deflector element/conveying element
$H_{IND}$ induction heating element passage height
$A_{HoriS}$ horizontal distance
$B_F$ lateral guide element passage width
V ratio
h rolled stock thickness
$B_{eff}$ strip width
$B_{IND}$ induction heating element passage width

The invention claimed is:

1. An apparatus (1) for increasing a temperature of elongate metallic rolled stock (2), having a heating unit (3) which comprises induction heating elements (4, 5, 6, 7; 104, 105, 106, 107) for heating the rolled stock (2) along a heating zone (8), and having a conveying device (15) which comprises roller table elements (27, 28) as active or passive conveying elements (18) for moving the rolled stock (2) along a longitudinal extension of the heating zone (8), wherein the induction heating elements (4, 5, 6, 7; 104, 105, 106, 107) are arranged spaced apart from one another in the longitudinal extension (9) of the heating zone (8) in each case by a free space (10, 11, 12), characterized in that a sliding deflector element (34, 35, 36, 37, 38, 39, 40, 41, 73) is arranged in each of the free spaces (10, 11, 12) at least one above and below a conveyance plane (16) of the heating zone (8) in order to prevent the rolled stock (2) from coming into contact with the induction heating elements (4, 5, 6, 7; 104, 105, 106, 107), and in that the sliding deflector element (38) and at least one other deflector element (41) are arranged opposite the roller table roller elements (27, 28)—in relation to the heating zone (8) as a deflector unit.

2. The apparatus (1) according to claim 1, characterized in that the sliding deflector element (34, 35, 36, 37, 38, 39, 40, 41, 73) is positioned outside of one of the surfaces of the induction heating elements (4, 5, 6, 7; 104, 105, 106, 107) that face the rolled stock (2).

3. The apparatus (1) according to claim 1, characterized in that the sliding deflector element (34, 35, 36, 37, 38, 39, 40, 41, 73) is positioned between one of the active or passive conveying elements (18) and one of the induction heating elements (4, 5, 6, 7; 104, 105, 106, 107).

4. The apparatus (1) according to claim 1, characterized in that the sliding deflector element (34, 35, 36, 37, 38, 39, 40, 41, 73) comprises a deflector top section (42) which is fixed in relation to the conveyed rolled stock (2).

5. The apparatus (1) according to claim 1, characterized in that the sliding deflector element (34, 35, 36, 37, 38, 39, 40, 41, 73) is positioned with its long side (55) aligned transversely to the longitudinal extension (9) of the heating zone (8), in the free space (10, 11, 12) between two immediately adjacent induction heating elements (4, 5, 6, 7; 104, 105, 106, 107).

6. The apparatus (1) according to claim 1, characterized in that a plurality of sliding deflector elements (34, 35, 36, 37, 38, 39, 40, 41, 73) are positioned extending over more than 60% of the heating zone width (56).

7. The apparatus (1) according to claim 1, characterized by a horizontal distance $A_{Hori}$ between the sliding deflector element (34, 35, 36, 37, 38, 39, 40, 41, 73) and an immediately adjacent induction heating element (4, 5, 6, 7; 104, 105, 106, 107), by an induction heating element distance $A_{INDHori}$ and by a sliding deflector element width B, where $A_{Hori}=\frac{1}{2}\times(A_{INDHori}-B)=(0 \text{ to } 25\%)\times A_{INDHori}$.

8. The apparatus (1) according to claim 1, characterized in that the sliding deflector element (34, 35, 36, 37, 38, 39, 40, 41, 73) is positioned spaced less than 100 mm from a nearest induction heating element (4, 5, 6, 7; 104, 105, 106, 107).

9. The apparatus (1) according to claim 1, characterized by an induction heating element passage height $H_{IND}$ and by a vertical distance $A_{VertA}$ or $A_{vertF}$ between the sliding deflector element (35, 38, 41, 73) positioned above the conveyance plane (16) and a further sliding deflector element (34, 36, 37, 39, 40) positioned below the conveyance plane or a roller table element, wherein $A_{VertA}$ or $A_{vertF} \leq H_{IND}$.

10. The apparatus (1) according to claim 1, characterized in that with an induction heating element passage height $H_{IND}$ of <200 mm the sliding deflector element (34, 35, 36, 37, 38, 39, 40, 41, 73) is positioned in one of the free spaces (10, 11, 12).

11. The apparatus (1) according to claim 1, characterized by a horizontal distance $A_{HoriS}$ between a lateral guide element (60, 61) and an immediately adjacent induction heating element (4, 5, 6, 7; 104, 105, 106, 107), by an induction heating element passage width $B_{IND}$ and by a lateral guide passage width BF, wherein $A_{HoriS}=\frac{1}{2}\times(B_{IND}-BF)=(0 \text{ to } 25\%)\times B_{IND}$.

12. The apparatus (1) according to claim 1, characterized in that the sliding deflector element and the at least one other deflector element are made of a temperature-resistant material and/or are internally cooled, wherein a coolant supply to one of thea cooled sliding deflector element (34, 35, 36, 37, 38, 39, 40, 41, 73) comprises a hose connection.

13. The apparatus according to claim 6, characterized in that the sliding deflector elements (34, 35, 36, 37, 38, 39, 40, 41, 73) are positioned extending over 90% of the heating zone width (56).

14. The apparatus according to claim 8, characterized in that the sliding deflector element (34, 35, 36, 37, 38, 39, 40, 41 and 73) is positioned spaced less than 40 mm from the nearest induction heating element (4, 5, 6, 7, 104, 105, 106, 107).

15. The apparatus according to claim 10, characterized in that with the induction heating element height $H_{IND}$<80 mm, the sliding deflector element (34, 35, 36, 37, 38, 39,40, 41, 73) is positioned in one of free spaces (10, 11, 12).

16. The apparatus (1) according to claim 1, characterized in that the sliding deflector element is positioned above the conveyance plane (16) of the heating zone (8) and a further deflector element is positioned below conveyance plane (16) vertically opposite the sliding deflector element, forming therewith a deflector unit.

17. The apparatus according to claim 1, characterized in that the sliding deflector element (38) and at least one other deflector element (41) and the induction heating elements (4, 5, 6) are arranged alternating with one another along the heating zone (8).

18. The apparatus according claim 1, characterized by at least one of a deflector unit including the sliding deflector element (35) and a further deflector element (34) vertically opposing the sliding deflector element (35), and a lateral guide unit including two horizontally opposing guide elements (60, 61) forming jointly or separately at least partially a rolled stock intake unit.

19. A finishing train for producing and/or working elongate metallic rolled stock (2), comprising an apparatus (1) for increasing a temperature of the elongate metallic rolled stock and having a heating unit (3) which comprises induction heating elements (4, 5, 6, 7; 104, 105, 106, 107) for heating the rolled stock (2) along a heating zone (8), and having a conveying device (15) which comprises roller table elements (27, 28) as active or passive conveying elements (18) for moving the rolled stock (2) along a longitudinal extension (9) of the heating zone (8), wherein the induction heating elements (4, 5, 6, 7; 104, 105, 106, 107) are arranged spaced apart from one another in the longitudinal extension (9) of the heating zone (8) in each case by a free space (10, 11, 12), wherein a sliding deflector element (34, 35, 36, 37, 38, 39, 40, 41, 73) is arranged in each of the free spaces (10, 11, 12) at least one above and below a conveyance plane (16) of the heating zone (8) in order to prevent the rolled stock (2) from coming into contact with the induction heating elements (4, 5, 6, 7, 104, 105, 106, 107), and wherein the sliding deflector element (38) and at least one other deflector element (41) are arranged opposite the roller table roller elements (27, 28)—in relation to the heating zone (8)—as a deflector unit.

20. An apparatus (1) for increasing a temperature of elongate metallic rolled stock (2), having a heating unit (3) which comprises induction heating elements (4, 5, 6, 7; 104, 105, 106, 107) for heating the rolled stock (2) along a heating zone (8), and having a conveying device (15) which comprises roller table elements (27, 28) as active or passive conveying elements (18) for moving the rolled stock (2) along a longitudinal extension (9) of the heating zone (8), wherein the induction heating elements (4, 5, 6, 7; 104, 105, 106, 107) are arranged spaced apart from one another in the longitudinal extension (9) of the heating zone (8) in each case by a free space (10, 11, 12), characterized in that a sliding deflector element (34, 35, 36, 37, 38, 39, 40, 41, 73) is arranged in each of the free spaces (10, 11, 12) at least one above and below a conveyance plane (16) of the heating zone (8) in order to prevent the rolled stock (2) from coming into contact with the induction heating elements (4, 5, 6, 7; 104, 105, 106, 107), and in that the sliding deflector element (38) and at least one other deflector element (41) are positioned so as to be vertically adjustable alone or in a frame, together with respective induction heating elements (5, 6).

21. A finishing train for producing and/or working elongate metallic rolled stock (2), comprising an apparatus (1) for increasing a temperature of the elongate metallic rolled stock and having a heating unit (3) which comprises induction heating elements (4, 5, 6, 7; 104, 105, 106, 107) for heating the rolled stock (2) along a heating zone (8), and having a conveying device (15) which comprises roller table elements (27, 28) as active or passive conveying elements (18) for moving the rolled stock (2) along a longitudinal extension (9) of the heating zone (8), wherein the induction heating elements (4, 5, 6, 7; 104, 105, 106, 107) are arranged spaced apart from one another in the longitudinal extension (9) of the heating zone (8) in each case by a free space (10, 11, 12), wherein a sliding deflector element (34, 35, 36, 37, 38, 39, 40, 41, 73) is arranged in each of the free spaces (10, 11, 12) at least one above and below a conveyance plane (16) of the heating zone (8) in order to prevent the rolled stock (2) from coming into contact with the induction heating elements (4, 5, 6, 7, 104, 105, 106, 107), and wherein the sliding deflector element (38) and at least one other deflector element (41) are positioned so as to be vertically adjustable alone or in a frame, together with respective induction heating elements (5, 6).

* * * * *